US005476149A

United States Patent [19]

Rickards

[11] Patent Number: 5,476,149

[45] Date of Patent: Dec. 19, 1995

[54] PILOT BIT

[75] Inventor: Brian Rickards, Fremont, Calif.

[73] Assignee: Pengo Corporation, Union City, Calif.

[21] Appl. No.: 407,795

[22] Filed: Mar. 20, 1995

Related U.S. Application Data

[63] Continuation of Ser. No. 228,827, Apr. 18, 1994, abandoned.

[51] Int. Cl.[6] ..... E21B 10/44

[52] U.S. Cl. ..... 175/388; 175/391

[58] Field of Search ..... 175/385, 386, 175/388, 391

[56] References Cited

U.S. PATENT DOCUMENTS 2,773,673 12/1956 Petersen .

3,508,622 4/1970 Benetti et al. ..... 175/388 X 4,623,025 11/1986 Verstraeten ..... 175/388 X

*Primary Examiner*—William P. Neuder

*Attorney, Agent, or Firm*—Townsend and Townsend and Crew

[57] ABSTRACT

A pilot bit is provided with an elongated body member and three blades that extend radially from and spirally along the body member. As compared to conventional two bladed pilot bits, the outer edge and leading tip of the third blade removes additional spoil which increases penetration rates. The pilot bit also includes an adapter which is inserted in an auger shaft and releasably secured thereto with a fastener, such as a bolt. The adapter includes a surface that cooperates with a key that is secured to the auger shaft to take the torque load off the bolt. In this manner, deformation of the auger shaft bolt holes and bolt fatigue is minimized.

29 Claims, 3 Drawing Sheets

PILOT BIT

This is a continuation of application Ser. No. 08/228,827, filed Apr. 18, 1994, now abandoned.

BACKGROUND OF THE INVENTION

The present invention relates to earth boring tools or augers, and more particularly to that portion of the auger which encounters the earth first, commonly referred to as a pilot bit, for breaking the way for larger portions of the auger.

Pilot bits generally are provided at the drilling end of an auger to guide the auger and keep it boring in the correct direction. Heretofore, flighted pilot bits have included two flutes or blades which are arranged in a double helix flighting configuration. Each blade extends radially from a core member with its outer edge forming a spiral cutting surface. With this configuration, two paths are defined between the blades for spoil to flow as the pilot bit is rotated to penetrate into the earth. Arrangements for releasably securing these bits have been developed to facilitate replacement of the bit when its cutting edges are worn out. One such arrangement is disclosed in U.S. Pat. No. 2,870,995 in which a drive lug is welded onto the shaft of the auger for receipt in a cavity formed in the pilot bit. The lug is bolted to the core member of the pilot bit and extends into the paths or channels formed between the pilot bit blades.

Although the two fluted pilot bit configuration provides large paths for spoil to flow, it has been found that this configuration results in undesirable drift. It is believed, that with only two cutting edges, if an obstruction or change in the earth formation being excavated is encountered, the bit can shift laterally since it is only supported by two diametrically opposed cutting edges. In addition, with the drive lug arrangement in which the bolt and nut extend through the pilot bit core member and beyond its surface, the bolt and nut act as obstructions to spoil flow along the outer surface of the core member. This reduces drilling rates since the bit only can drill as fast as the spoil is removed from the hole. The constant flow of the spoil over the nut also wears out the nut and bolt threads so that it is difficult to remove the nut and replace the pilot bit.

SUMMARY OF THE INVENTION

The present invention is directed to a pilot bit that avoids the problems and disadvantages of the prior art. According to the present invention a pilot bit is provided with an elongated body member and three flutes or blades that extend radially from and spirally along the body member. As compared to conventional two bladed pilot bits, the outer edge and leading tip of the third blade removes additional spoil which increases penetration rates. The third blade also provides a cleaner hole than that provided by conventional two bladed pilot bits due to the additional blade surfaces that sweep the sides of the hole while carrying spoil therefrom. The third blade also increases the total blade edge surface area, thereby reducing wear of any one blade.

In the preferred embodiment, the three blades are equidistantly spaced in the circumferential direction. With this construction, the pilot bit is less prone to walking when starting a hole as compared to conventional two bladed pilot heads. This balanced triangular stabilization also improves the ability of the pilot to start on a slant (e.g., on a hill), where the auger is not perpendicular to the ground, without walking. This is due to the stabilization provided by the third blade which offsets the forces of the other blades as they begin to penetrate into the surface of the soil. In addition, the triangular configuration stabilizes the auger after the hole has been started. For example, with three cutting surfaces equally spaced about the elongated body member of the pilot, the pilot bit is prevented from laterally moving in the event an obstruction or a hard earth formation is encountered.

Although a pilot bit having more than three blades, e.g., four blades, may improve auger stabilization as compared to a two bladed configuration, overcrowding of blades becomes a problem in the four bladed configuration. This is due to the restricted area in which the pilot blades must be arranged on the end of the pilot, as well as the limited dimensions of the pilot bit. For example, pilot bit diameters are generally limited to a range of about 2 ½ to 3 ½ inches. With the blades overcrowded, the relatively narrow channels between the blades impede spoil flow. Thus, a pilot bit having four blades provides lower drilling rates than a three bladed bit. The addition of a fourth blade also would add unnecessary weight and increase manufacturing costs.

According to another advantageous aspect of the invention, the drive of the pilot bit head is designed to be an extension of and adapter for the auger shaft. The elongated body member of the pilot bit includes a first end portion or adapter for coupling to an auger shaft, a second end portion from which the blades extend and an intermediate portion that spaces the first end portion and auger shaft from the second end portion and pilot blades.

The adapter of the pilot bit is provided with a flat outer side surface and diametrically opposed holes for receiving a bolt. The adapter is inserted into the hollow auger shaft, which includes cooperating through holes. A bolt is extended through the holes to secure the pilot head to the auger shaft. A key, fixed to the inner wall of the auger shaft, mates with the flat side surface of the adapter to take the torque load off of the bolt. In this manner, elongation of the bolt hole in the auger shaft, as well as bolt fatigue are minimized. Otherwise, the auger shaft bolt hole could deform and enlarge, resulting in undesirable vibration of the pilot bit when drilling. Bolt failure also could result.

A further advantageous aspect of the invention is that the intermediate portion of the pilot bit is constructed so that when the pilot bit is coupled to an auger shaft having a boring head at its working end, the intermediate portion spaces the pilot bit blades from the auger shaft so that at least one of the auger teeth extending from the boring head can be positioned between the pilot blades and the auger shaft. In this manner, the auger tooth can be positioned such that its distal end widens the hole dug by the pilot bit to provide ample space for the auger shaft to follow. The intermediate portion configuration also permits the remaining teeth to be positioned so that when starting a hole, the auger teeth drill after the pilot bit, but before the auger shaft enters the ground. If the pilot bit blades are not sufficiently spaced from the auger shaft, then the spoil from the pilot bit has no route to escape out of the hole and onto the flights of the auger. By spacing the pilot bit blades away from the auger shaft, the innermost tooth on the boring head can start to cut clearance for the shaft and transfer spoil to the flighting before the auger shaft enters into the ground.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENT

Figure 1:
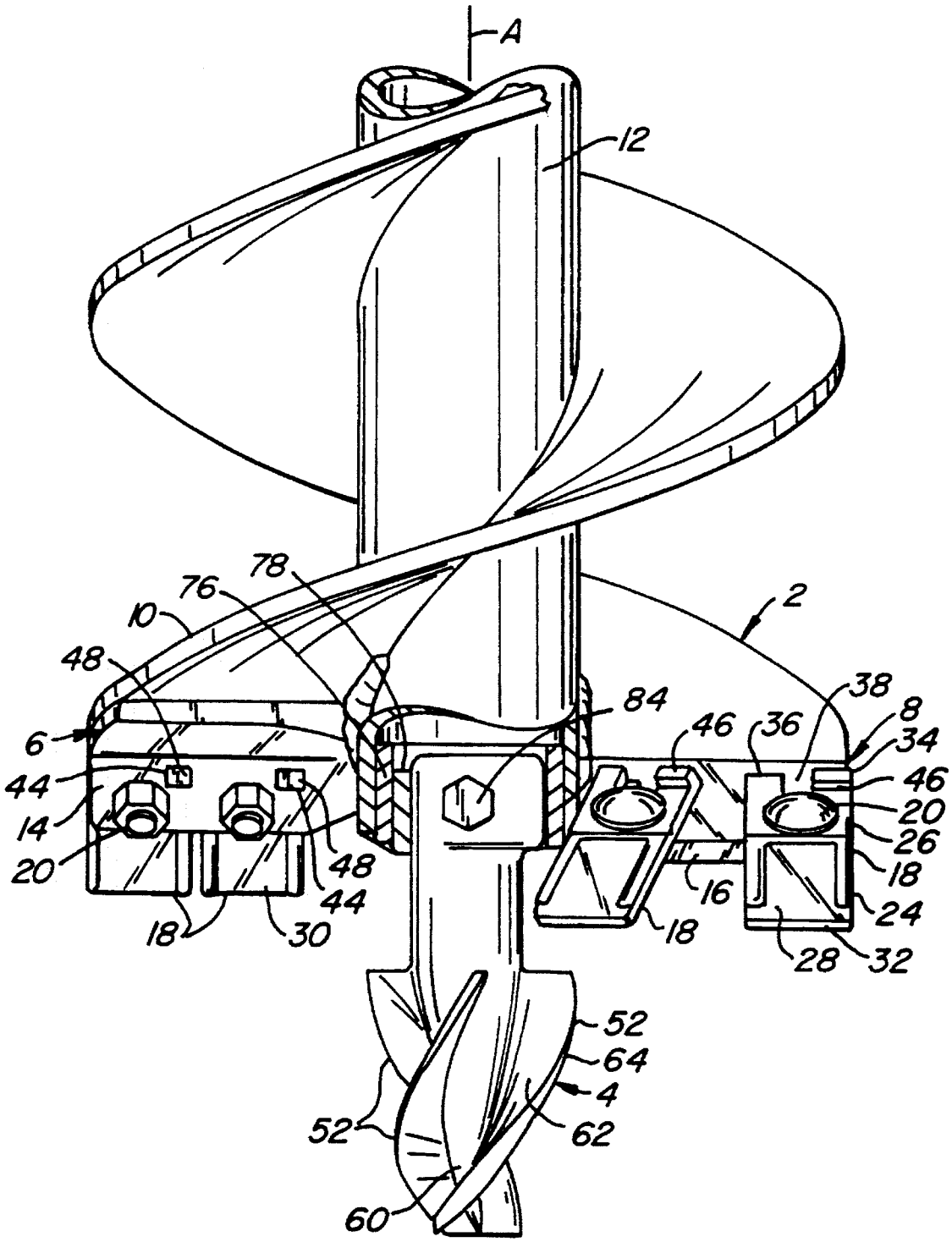
FIG. 1 is a side view of an auger assembly constructed according to the principles of the present invention showing the coupling between the pilot bit and auger shaft in section.

Referring to the drawings in detail, wherein like numerals indicate like elements, FIG. 1 illustrates an auger assembly constructed in accordance with the present invention. The auger assembly generally includes auger 2 and pilot bit 4. Auger 2 includes a boring head comprising shank assemblies 6 and 8 which are shown secured to flighting 10. It should be understood, however, that other boring head configurations or arrangements can be used without departing from the scope of the invention and that the particular construction of the boring head illustrated in the drawings is merely shown for purposes of example. However, in the preferred embodiment the pilot bit and one of the teeth on the boring head preferably are arranged to cut clearance for the auger shaft as shown in the drawings and discussed in more detail below. Returning to FIG. 1, flighting 10 is helically wound around auger shaft 12 to convey spoil to the surface of the area being excavated as is conventional in the art. Pilot bit 4 is provided at the drilling end of the auger to cut clearance for auger shaft 12.

Figure 2:
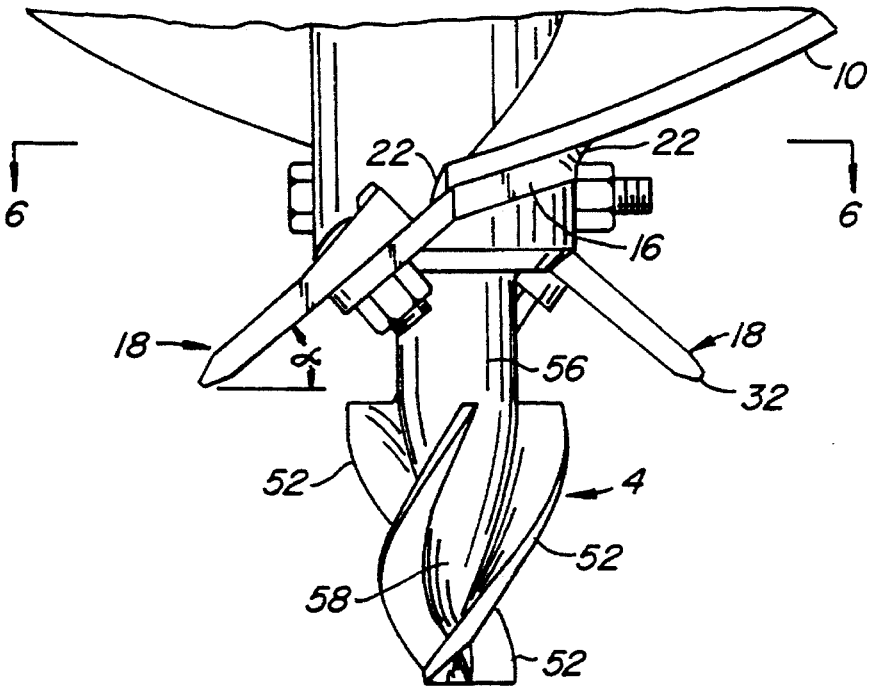
FIG. 2 is a further view of the auger assembly of FIG. 1 rotated 90°.
Figure 6:
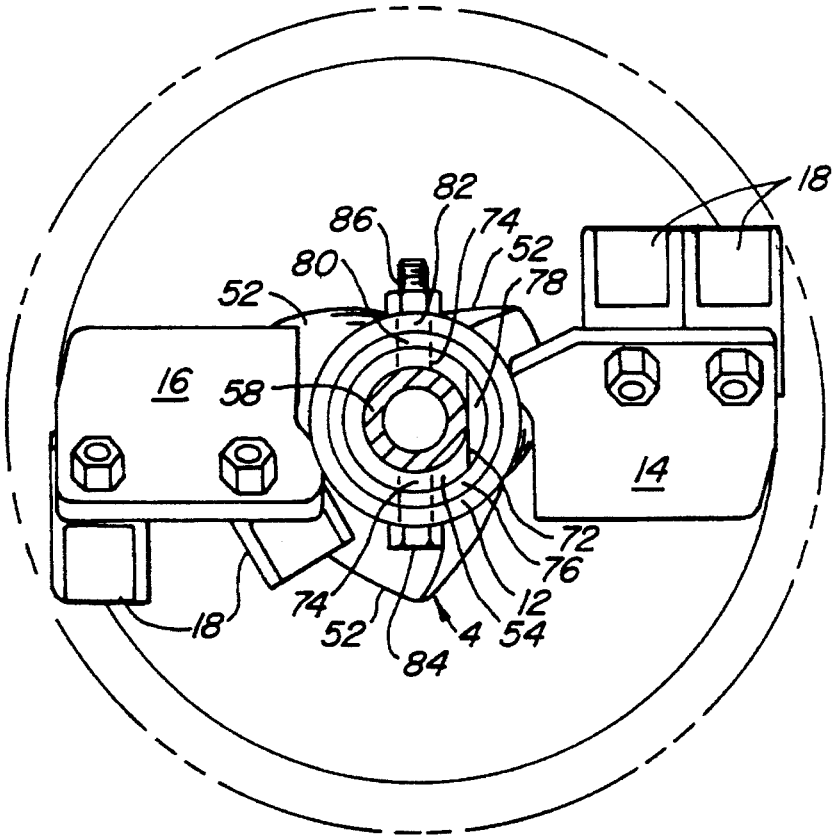
FIG. 6 is a sectional view of the auger shaft and pilot bit taken along line 6—6 in FIG. 2 with the shank plate assemblies shown therearound.

In the embodiment illustrated in FIGS. 1, 2 and 6, shank plate assemblies 6 and 8 generally include shank plates 14 and 16, which are secured to flighting 10, drilling elements or teeth 18, and fasteners 20, which secure the teeth to the shank plates. Referring to FIG. 2, the shank plates can be secured to flighting 10 by welding, as indicated by reference numeral 22, for example (shank plate 14 being hidden from view). Shank plates 14 and 16 differ in the arrangement of their tooth mounting holes, which will be discussed in more detail below, so that one of the teeth can be angled radially inwardly, as shown in FIG. 1, to ensure that clearance is cut for auger shaft 12. Although a four tooth arrangement is shown, which is suitable for 12, 16, 18, 24 and 30 inch diameter boring heads, for example, other arrangements can be used to accommodate other boring head dimensions as would be apparent to one of ordinary skill. Each tooth 18 is similarly configured and includes a distal portion 24 and a proximal portion 26. Distal portion 24 includes top and bottom faces 28 and 30 which terminate in digging or cutting end 32. The distal portion can be tapered as is conventional in the art in which faces 28 and 30 are angled downwardly in the forward direction toward end 32. Proximal portion 26, which is configured for fastening the tooth to the shank plate, includes two laterally spaced prongs 34 and 36 which form slot 38 therebetween. Slot 38 extends forwardly from the proximal ends of the prongs toward distal portion 24. Slot 38 preferably is rectangular in shape and terminates in a substantially planar end wall to cooperate with a square shanked fastener. That is, fastener 20 preferably is a carriage bolt having a square upper shank portion 48, which is dimensioned to fit snugly in slot 38. The engagement of the square shank with the side walls of slot 38 prevents the tooth from getting out of alignment with the shank plate and prevents relative rotation between the fastener and tooth.

Each prong has a top face 40, 42 which together preferably form a substantially flat mounting surface for mounting to the shank plate when the tooth is turned over. The bottom faces (not shown) of each prong pair form a mirror image of the top faces so that the tooth can be mounted to the shank plate as shown in FIGS. 1, 2 and 6. The top and bottom mounting surfaces are substantially nonparallel so that the attack angle $\alpha$ (FIG. 2) can be changed when the tooth is reversed to alternate which mounting surface contacts the shank plate. Prongs 34 and 36 preferably also have depressions formed therein adjacent slot 38 to form bolt head seating surfaces. The bolt seating surface formed in the prong top faces is substantially parallel to tooth mounting surface on the opposite side of the tooth, while the bolt seating surface formed in the prong bottom faces is substantially parallel to tooth mounting surface on the opposite side thereof, i.e., the tooth mounting surface formed by top face pair 40, 42. With this configuration, fastener 20 is maintained essentially perpendicular to the shank plate to which the tooth is mounted and the contact area between the bolt head and tooth and the nut and shank plate is maximized to enhance the securement of the tooth to the shank plate.

Each shank plate includes a bolt hole for receiving fastener 20 and a lug-receiving recess or through hole 44 for receiving either tooth lug 46 or 48 depending on the position of tooth 18. More specifically each prong 34 includes a lug 46 and each prong 36 includes a lug 48. Each lug extends beyond and is generally perpendicular to the portion of the mounting surface adjacent thereto. Lugs 46 and 48 each have a configuration generally corresponding to that of recess 44 and are dimensioned to snugly fit in that recess so that the lug always is sufficiently in contact with an inner wall(s) of the recess to prevent relative movement therebetween and transfer forces from the tooth to the shank plate. In this way, stress transfer through the bolt is minimized, thereby enhancing the life of fastener 20. That is, the interlock between the lug and the shank plate reduces the load on the fastener. As shown in the drawings, each lug preferably is tapered to provide the desired fit within a respective recess 44. Although a particular tooth configuration has been described, it should be understood that other tooth configurations can be used without departing from the scope of the present invention.

Referring to FIGS. 3–6, pilot bit or head 4 generally comprises an elongated main body 50 and three radially extending blades 52 formed integrally therewith. Main body 50 includes a proximal end portion or base 54, which is adapted to be coupled to auger shaft 12, necked down intermediate portion or extension 56, and conically shaped distal end portion 58. When pilot bit 4 is coupled to auger shaft 12, the rotational axis A' of elongated body member 50 is collinear with rotational axis A of auger shaft 12 (see FIG. 1 and 3).

The apex 60 of the cone shaped portion 58 is disposed to enter the earth first. The particular contour of radial blades 52 is described in more detail below with reference to FIG. 3–6.

Figure 4:
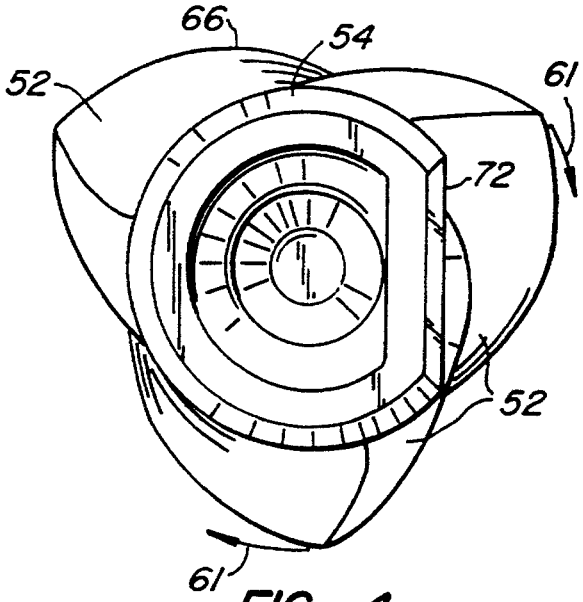
FIG. 4 is a top plan view of the pilot bit of FIG. 1.

Blades 52 are equidistantly spaced about rotational axis A' of elongated main body 50 and extend spirally along conical end portion 58. That is, blades 52 extend in spiral fashion from the side wall of conical end portion 58, the spiral advancing in screw fashion in the general direction of rotation of the pilot bit indicated by arrows 61 during cutting of the earth thereby (FIG. 4). Each blade also extends essentially the same distance beyond rotational axis A' of elongated body 50.

Figure 3:
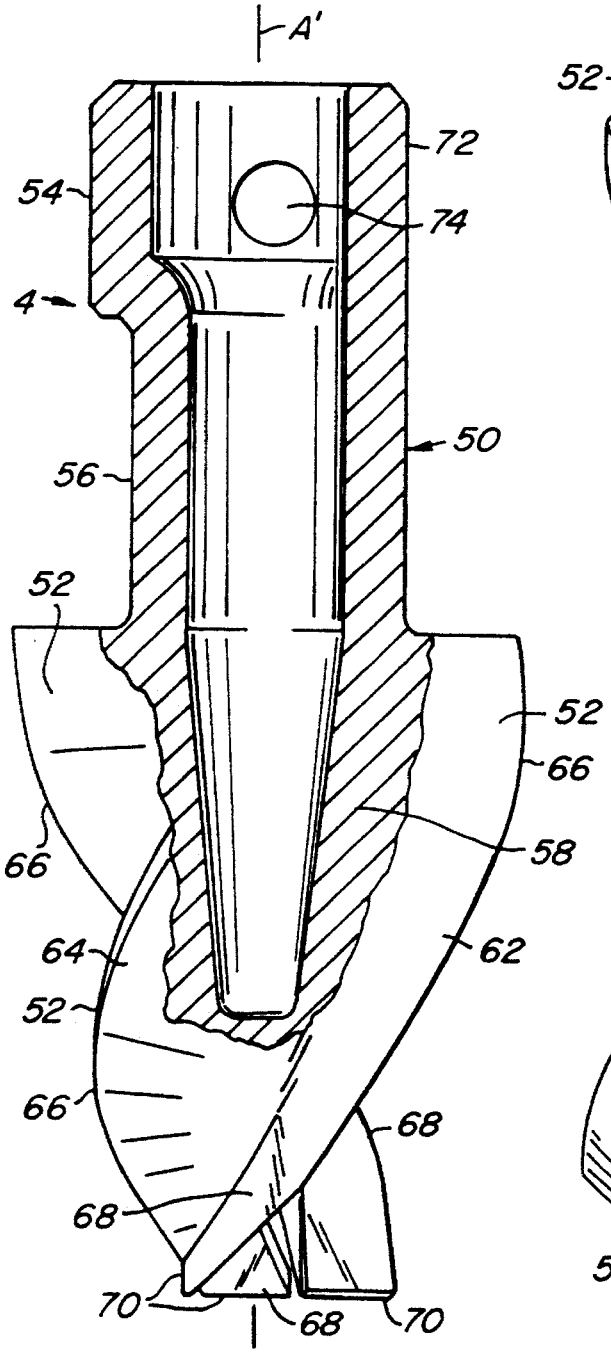
FIG. 3 is a side view of the pilot bit of FIG. 1 with the body member of the bit shown in longitudinal cross-section.

Referring to FIG. 3, it will be noted that each blade 52 is of concave-convex contour, concave face 62 leading and the convex face 64 trailing relative to the direction of rotation of the pilot bit. It will therefore be seen that each blade has its outer spiral edge 66 disposed slightly in advance of the zone of connection of the blade with the cone body. This affords a cutting action which in effect is a shaving of the earth at the spiral edge 66 as well as a tendency for the earth cut thereby to curve rearwardly into the concave face 62 at the leading side of the blade.

Figure 5:
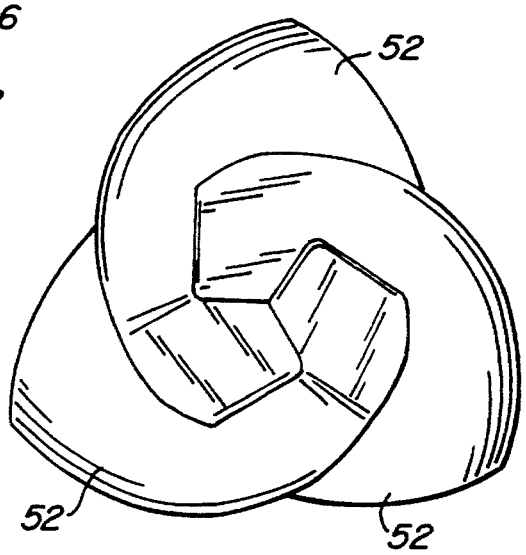
FIG. 5 is a bottom plan view of the pilot bit of FIG. 1.

The disposition of the spiral edge 66 of each blade diminishes in dimension radially from the axis A' gradually in each increment of descent from the upper end of conical portion 58 to apex 60. At the plane of the apex 60 of the cone body 11, the spiral edge 18 of each blade is still a slightly greater distance radially from the axis A' than the perimeter. Each blade continues spirally beyond the plane in which the apex 60 lies to provide a fin 68 which together form a leader for the pilot bit. From the foregoing it will be seen that each fin 68 of the leader 20 in advance of the apex 60 of the conical portion 58 constitutes a chisel-like cutter. Each of these chisel-like cutters has a leading cutting edge 70 which is disposed in a plane substantially perpendicular to the axis A' about which the elongated main body 50 rotates. It should here be noted that while each blade 52 is of concave-convex contour in a radial direction throughout its length from the upper portion of cone portion 58 down to the apex 60 of the portion 58, the chisel-like extension 68 of each blade is substantially flat on its leading and trailing faces as best illustrated in FIGS. 3 and 5.

From the foregoing it will be noted that the cutting performed by the cutting edges 70 is a slicing action due to the angular disposition of these cutting edges relative to the direction of their movement. The leader formed by fins 68, as explained above, has a spread greater than that cone apex 60 so that the initial cut made by the three chisel-like extensions 68 provide a hole in the earth sufficient to admit the conical portion 58.

The pilot bit is provided with an adapter or base 54 for coupling to the bit to auger shaft 12. Base 54 comprises a generally cylindrical member that includes a flat outer side surface 72 and diametrically opposed through holes 74 which are spaced from flat surface 74 for receiving a bolt as seen in FIGS. 3, 4 and 6. Referring to FIGS. 1 and 6, the drilling end of hollow auger shaft 12 is provided with an adapter ring 76 which is preferably permanently fixed thereto, e.g., by welding to adapt the inner diameter of the auger shaft to accommodate base 54 if the pilot bit. Thus, ring 76 has a key 78 fixed thereto and is dimensioned to receive base 54. Key 76 includes a flat section for cooperating with flat surface 76 of base 54 and preventing relative rotation therebetween. In the case where an adapter ring is not necessary, i.e., when the outer diameter of base 54 is only slightly smaller than inner diameter of auger shaft 12, key 78 is directly fixed to the inner wall of the auger shaft. To couple pilot bit 4 to the auger shaft, base 54 is inserted in ring 76 with flat surface 72 abutting the corresponding flat surface on key 78 and bolt holes 74 aligned with bolt holes 80 and 82 which are formed in adapter ring 76 and auger shaft 12, respectively. Bolt 84 is extended through holes 74, 80 and 82 and secured with nut 86 to couple the pilot head to the auger shaft. As the auger shaft and pilot bit are turned, key 78, which mates with the flat side surface of base 54, takes the torque load off of the bolt. In this manner, elongation of the bolt hole in the auger shaft, as well as bolt fatigue are minimized. Otherwise, the auger shaft bolt hole could deform and enlarge, resulting in undesirable vibration of the pilot bit when drilling. Bolt failure also could result. It should be understood, however, that other key configurations or interlocking mechanism can be used in conjunction with the coupling bolt to take up the torque load without departing from the scope of the invention.

Another important feature of the invention is that the intermediate portion 56 of the pilot bit 4 is constructed to form an extension for the auger shaft and permit the introduction of a boring tooth to facilitate conveyance of spoil from blades 52 to flighting 10 so that when the pilot bit is coupled to an auger shaft having a boring head at its working end. That is, intermediate portion is dimensioned to space pilot bit blades 52 from auger shaft 12 and has a substantially small diameter than shaft 12 and base 54 so that the distal end of at least one of the auger teeth extending from the boring head can be positioned between the pilot bit blades and the auger shaft and adjacent the area where the spoil exits blades 52. This is best illustrated in FIGS. 1 and 6 where the innermost tooth on shank plate 16 is positioned. In sum, with the pilot bit configured as described above, the auger tooth can be positioned such that its distal end widens the hole dug by the pilot bit to provide ample space for the auger shaft to follow and to convey spoil from the pilot bit to flighting 10. The intermediate portion configuration also permits the remaining teeth to be positioned so that when starting a hole, the auger teeth drill after the pilot bit, but before the auger shaft enters the ground. If the pilot bit is not extended so that the blades are spaced from the auger shaft, then the spoil from the pilot bit has no route to escape out of the hole and onto the flights of the auger. It has been found that an intermediate portion length of about 1½" to 2½" provides optimum results.

Since the fins 68 initially cuts a hole into the earth sufficient to admit the conical portion 58 and the fragments of earth thus cut are immediately diverted up the concave leading face 62 of each blade 52, it will be apparent that compression of such earth fragments or spoil is minimized. This assures against plugging up of the pilot bit particularly when heavy clays such as pliable soils with homogeneous tendencies are encountered. In other words, each of the spiral blades 52 serves as a moldboard for shaping the spoil, confining it within the radial extent of the spiral edges 66 while conveying such spoil in serpentine fashion upwardly around the conical portion 58 to the tooth that is angled inwardly to a position between blades 52 and base 54. That tooth then displaces the spoil to flighting 10 which conveys the spoil to surface of the area being excavated. Thus, the spoil is promptly displaced and removed as the pilot bit advances into the earth and packing of or resistance by the spoil eliminated.

The above is a detailed description of a particular embodiment of the invention. It is recognized that departures from the disclosed embodiment may be made within the scope of the invention and that obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. A pilot bit comprising:

an elongated body member having a first and second end portions, said first end portion adapted for coupling to an end of an auger shaft;

a number of blades extending radially from and being substantially equidistantly spaced about said elongated body member second end portion, said number being three, each blade further extending spirally along said second end portion of the elongated body member; and said elongated body member including an intermediate portion between said first and second end portions, the outer diameter of said intermediate portion being less than the outer diameter of said end the auger shaft.

2. The pilot bit of claim 1 wherein each blade has a concave leading face and a convex trailing face, each leading face facing the trailing face on the blade adjacent thereto.

3. The pilot bit of claim 1 wherein each blade terminates in a fin that extends beyond said second end portion of the elongated body member.

4. The pilot bit of claim 1 wherein said second end portion of the elongated body member is cone-shaped.

5. The pilot bit of claim 1 wherein said first end portion includes a base that is substantially spaced from said blades, said base having an outer circumferential wall surface, at least a portion of said outer wall surface being flat, said base further including a pair of diametrically opposed holes configured for receiving a bolt.

6. The pilot bit of claim 1 wherein said first end portion includes a base that is substantially spaced from said blades, said base having an outer circumferential wall surface, at least a portion of said outer wall surface being flat, said base further including a pair of diametrically opposed holes configured for receiving a bolt.

7. An auger assembly comprising:

auger shaft having first and second end portions;

flighting extending radially from said auger shaft, said flighting further extending spirally along said shaft and terminating in the vicinity of said second end portion;

an elongated body member having first and second end portions, said elongated body member first end portion being releasably coupled to said second end portion of said auger shaft;

a number of blades extending radially from and being substantially equidistantly spaced about said elongated body member second end portion, said number being three, each blade further extending spirally along said second end portion of the elongated body member; and said elongated body member including an intermediate portion between said first and second end portions of the elongated body member, the outer diameter of said intermediate portion being less than the outer diameter of said second end portion of the auger shaft.

8. The auger assembly of claim 7 wherein each blade has a concave leading face and a convex trailing face, each leading face facing the trailing face on the blade adjacent thereto.

9. The auger assembly of claim 7 wherein each blade includes a fin that extends beyond said elongated body member second end portion.

10. The auger assembly of claim 7 wherein the rotational axis of said auger shaft and the rotational axis of said elongated member are essentially collinear.

11. The auger assembly of claim 10 wherein the distance between a portion of one of said blades and the rotational axis of said elongated body member is greater than the outer radius of said second end portion of the auger shaft such that upon rotation said blades form a hole having a diameter greater than the second portion of the auger shaft.

12. The auger assembly of claim 7 further including a key and a fastener for securing said first end portion of the elongated body member to said second end portion of the auger shaft and wherein said first end portion of the elongated body member comprises a base, said base having an outer circumferential wall surface of which at least a portion is substantially flat, said base being positioned in said second end portion of the auger shaft, said key being fixedly coupled to said auger shaft and having a substantially flat surface, said substantially flat key surface abutting said substantially flat surface of the base to prevent relative rotation between said base and auger shaft, said fastener extending through said base and auger shaft.

13. The auger assembly of claim 7 further including multiple teeth coupled to said auger shaft, at least one of said teeth extending toward the rotational axis of said auger shaft to a location between said auger shaft and said blades.

14. An auger assembly comprising a pilot bit in combination with an auger including an auger shaft having a first end portion and a second hollow end portion, flighting extending radially from and spirally along said auger shaft, a boring head coupled to said second end portion of the auger shaft and having multiple teeth, and a key having a substantially flat surface and being fixedly positioned in the interior of said second end portion of the auger shaft, said pilot bit comprising:

an elongated body member having first and second end portions and an intermediate portion disposed therebetween, said first end portion being positioned in said hollow second end portion of the auger shaft and comprising a base having an outer circumferential wall surface of which at least a portion is substantially flat, said substantially flat base surface abutting said substantially flat key surface to prevent relative rotation between said base and auger shaft;

a fastener extending through said auger shaft and base for releasably securing the elongated body member to the auger shaft;

a number of blades extending radially from and spirally along said second end portion of the elongated body member, said blades being substantially equidistantly spaced about said elongated body member, and said number of blades being three; and said elongated body member including an intermediate portion between said first and second end portions of the elongated member, the outer diameter of said intermediate portion being less than the outer diameter of said second end portion of the auger shaft.

15. The auger assembly of claim 13 wherein at least one of said teeth extends toward the rotational axis of said auger shaft to a location between said auger shaft and said blades.

16. A pilot bit, for use with an auger to guide the auger as the auger bores a hole in the earth and directs the spoil through the hole, comprising:

an elongated body member having a first and second end portions, said first end portion adapted for coupling to the auger;

three blades extending radially from and being substantially equidistantly spaced about said elongated body member second end portion, each blade further extending spirally along said second end portion of the elongated body member; and means for directing the spoil created by the three blades towards the auger for movement through the hole created thereby.

17. The pilot bit of claim 16 where each blade has a concave leading face and a convex trailing face, each leading face facing the trailing face on the blade adjacent thereto.

18. The pilot of claim 16 wherein each blade terminates in a fin that extends beyond said second end portion of the elongated body member.

19. The pilot bit of claim 16 where said second end portion of the elongated body member is cone-shaped.

20. An auger assembly comprising:

an auger comprising:

an auger shaft having first and second end portions; and flighting extending radially from said auger shaft, said flighting further extending spirally along said shaft and terminating in the vicinity of said second end portion; and a pilot bit, mounted to the auger, comprising:

an elongated body member having first and second end portions, said elongated body member first end portion being releasably coupled to said second end portion of said auger shaft;

three blades extending radially from and being substantially equidistantly spaced about said elongated body member second end portion, each blade further extending spirally along said second end portion of the elongated body member; and means for directing spoil created by the three blades to the flighting of the auger for movement through a hole created by the auger.

21. The auger assembly of claim 20 wherein each blade has a concave leading face and a convex trailing face, each leading face facing the trailing face on the blade adjacent thereto.

22. The auger assembly of claim 20 wherein each blade includes a fin that extends beyond said elongated body member second end portion.

23. The auger assembly of claim 23 wherein the rotational axis of said auger shaft and the rotational axis of said elongated member are essentially collinear.

24. The auger assembly of claim 23 wherein the distance between a portion of one of said blades and the rotational axis of said elongated body member is greater than the outer radius of said second end portion of the auger shaft such that upon rotation said blades form a hole having a diameter greater than the second portion of the auger shaft.

25. The auger assembly of claim 20 further including a key and a fastener for securing said first end portion of the elongated body member to said second end portion of the auger shaft and wherein said first end portion of the elongated body member comprises a base, said base having an outer circumferential wall surface of which at least a portion is substantially flat, said base being positioned in said second end portion of the auger shaft, said key being fixedly coupled to said auger shaft and having a substantially flat surface, said substantially flat key surface abutting said substantially flat surface of the base to prevent relative rotation between said base and auger shaft, said fastener extending through said base and auger shaft.

26. The auger assembly of claim 20 wherein said elongated member includes an intermediate portion between said first and second end portions of the elongated member, the outer diameter of said intermediate portion being less than the outer diameter of said second end portion of the auger shaft.

27. The auger assembly of claim 23 further including multiple teeth coupled to said auger shaft, at least one of said teeth extending toward the rotational axis of said auger shaft to a location between said auger shaft and said blades.

28. An auger assembly comprising a pilot bit in combination with an auger including an auger shaft having a first end portion and a second hollow end portion, flighting extending radially from and spirally along said auger shaft, a boring head coupled to said second end portion of the auger shaft and having multiple teeth, and a key having a substantially flat surface and being fixedly positioned in the interior of said second end portion of the auger shaft, said pilot bit comprising:

an elongated body member having first and second end portions and an intermediate portion disposed therebetween, said first end portion being positioned in said hollow second end portion of the auger shaft and comprising a base having an outer circumferential wall surface of which at least a portion is substantially flat, said substantially flat base surface abutting said substantially flat key surface to prevent relative rotation between said base and auger shaft;

a fastener extending through said auger shaft and base for releasably securing the elongated body member to the auger shaft;

three blades extending radially from and spirally along said second end portion of the elongated body member, said blades being substantially equidistantly spaced about said elongated body member; and means for directing spoil created by the three blades to the flighting of the auger for movement through a hole created by the auger assembly.

29. The auger assembly of claim 26 wherein at least one of said teeth extends toward the rotational axis of said auger shaft to a location between said auger shaft and said blades.

* * * * *